US006421946B1

(12) United States Patent
LoRocco

(10) Patent No.: US 6,421,946 B1
(45) Date of Patent: Jul. 23, 2002

(54) REMOVABLE SIGHT ASSEMBLY FOR WEAPONS

(75) Inventor: Paul M. LoRocco, Dallas, TX (US)

(73) Assignee: Tru-Glo, Inc., Dallas, TX (US)

( * ) Notice: Subject to any disclaimer, the term of this patent is extended or adjusted under 35 U.S.C. 154(b) by 0 days.

(21) Appl. No.: 09/737,677

(22) Filed: Dec. 14, 2000

Related U.S. Application Data

(60) Provisional application No. 60/173,237, filed on Dec. 28, 1999.

(51) Int. Cl.[7] ..... F41G 1/32; F41G 1/38

(52) U.S. Cl. ..... 42/111; 42/124; 42/132; 42/145; 42/112

(58) Field of Search ..... 42/111, 112, 124, 42/127, 132, 144, 145

(56) References Cited

U.S. PATENT DOCUMENTS

| | | | | | |
|---|---|---|---|---|---|
| 701,289 | A | | 6/1902 | Browning | 33/47 |
| 2,239,231 | A | | 4/1941 | Hooks | 33/47 |
| 2,385,649 | A | * | 9/1945 | Prideaux | 42/132 |
| 2,519,220 | A | * | 8/1950 | Bentley | 42/141 |
| 2,615,252 | A | * | 10/1952 | Wing | 42/144 |
| 2,855,680 | A | * | 10/1958 | Christensen | 42/148 |
| 2,874,504 | A | * | 2/1959 | Martinek | 42/76.01 |
| 3,222,022 | A | * | 12/1965 | Akin, Jr. | 248/205.1 |
| 3,626,597 | A | | 12/1971 | Darrah | 33/50 |
| 3,840,995 | A | | 10/1974 | Freiling | 33/233 |
| 3,974,586 | A | * | 8/1976 | Kappner | 42/112 |
| 4,008,536 | A | | 2/1977 | Adams | 42/1 |
| 4,328,624 | A | | 5/1982 | Ross | 33/245 |
| 4,745,686 | A | | 5/1988 | Willis | 42/136 |
| 4,941,277 | A | * | 7/1990 | Lawlor | 42/112 |
| 5,068,968 | A | * | 12/1991 | Sillery | 89/200 |
| 5,836,100 | A | * | 11/1998 | Stover | 42/132 |
| 5,878,503 | A | * | 3/1999 | Howe et al. | 42/132 |
| 6,014,830 | A | | 1/2000 | Brown et al. | 42/100 |
| 6,058,615 | A | | 5/2000 | Uhlmann et al. | 42/132 |

FOREIGN PATENT DOCUMENTS

| | | |
|---|---|---|
| GB | 2175676 | 12/1986 |

OTHER PUBLICATIONS

Patentability Search Report from Epsilon Patent Searching dated Dec. 1, 2000.

Copy of International Search Report for PCT/US/34901 (2 pages).

* cited by examiner

*Primary Examiner*—Charles T. Jordan
*Assistant Examiner*—John W. Zerr
(74) *Attorney, Agent, or Firm*—Jenkens & Gilchrist, P.C.

(57) ABSTRACT

An inner sleeve is pressed, when installed on a weapon, between a feature of the weapon such as a rib, rail, or barrel, and an outer sleeve. An aiming indicia is mounted on the outer sleeve.

12 Claims, 3 Drawing Sheets

REMOVABLE SIGHT ASSEMBLY FOR WEAPONS

This application claims benefit of provisional application Ser. No. 60/173,237 filed Dec. 28, 1999.

BACKGROUND OF THE INVENTION

1. Technical Field

This invention relates generally to a removable sight for weapons, and more particularly to a removable sight for weapon barrels having a rib, rail, dovetailed recess, or an external surface of the barrel on which a removable sight can be mounted.

2. Background Art

Alignment sights, and particularly the front or rear sights of hand-held weapons are generally attached by magnets, screws, tape, or if intended to be permanently attached to the barrel, by welding or soldering in place. With the exception of a weld-attached sight such as a bead or blade, screw-attached, magnetic, and tape-attached sights are generally intended for selective removal and attachment. However, the magnetic and tape-attached sight, in particular, can be displaced during handling or use and therefore may not be correctly aligned for subsequent use when firing the weapon.

The present invention is directed to overcoming the position retention problems of magnetically and adhesive or tape-attached sights, and the problem of needing special tools to remove screw-mounted sights.

SUMMARY OF THE INVENTION

In one aspect of the present invention, a removable sight assembly for a weapon includes an aiming indicia member mounted on an outer sleeve that is adapted to circumscribe an inner sleeve. The inner sleeve is pressed between the outer sleeve and a predefined feature of the weapon when the removable sight is mounted on the weapon.

BRIEF DESCRIPTION OF THE DRAWINGS

A more complete understanding of the structure and operation of the present invention may be had by reference to the following detailed description, when taken in conjunction with the accompanying drawings, wherein.

DETAILED DESCRIPTION OF PRESENTLY PREFERRED EXEMPLARY EMBODIMENTS

Figure 1:
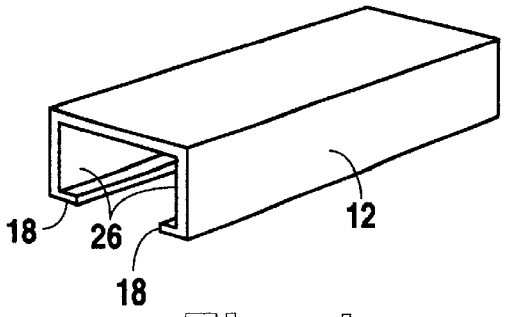
FIG. 1 is a three-dimensional view of a first embodiment of an inner sleeve component of the removable sight assembly embodying the present invention.

In a preferred embodiment of the present invention, a removable sight assembly 10 comprises two primary components or sub-assemblies. The first component is an inner sleeve 12, such as shown in various embodiments in FIGS. 1 and 4–7. The inner sleeve 12 is preferably formed of a compressible, and desirably somewhat flexible, material having a predefined hardness, such as ABS plastic or other rubber or plastic material having a predefined relatively low hardness. The inside shape of the inner sleeve 12 is adapted to provide a tight, i.e., substantially line-to-line, or preferably even a slight interference, fit with the top and sides of a rib 14 of a barrel 16, as illustrated in FIGS. 1 and 4–7, and has a pair of inwardly extending feet 18 on a lower portion of the sleeve 12 that wrap around a portion of the bottom of the rib 14. The rib 14 is elevated, in spaced relationship, above the outer surface of the barrel 16 of the weapon. To assemble the inner sleeve 12, the sides of the inner sleeve 12 are slightly spread and the sleeve 12 snapped over the rib 14 and pushed forward to the forward end of the barrel 16 so that the inner sleeve 12 is positioned adjacent an existing bead or blade disposed at a forward end of the barrel 16 if the removable sight 10 is to be mounted for use as a front sight. If the removable sight 10 is used as a rear sight, it can be advantageously positioned at a rear portion of the barrel 16.

The second primary component is an outer sleeve 22 that has a sight or aiming indicia, such as an elongated fluorescent light-gathering optical fiber 24 mounted thereon. The outer sleeve 22 is formed of a material having a predefined hardness that is desirably greater than that of the inner sleeve 12, for example a metal or rigid plastic material which also may have less flexibility than that of the inner sleeve 12. The inner configuration of the outer sleeve 22 is adapted to maintain the inner sleeve 12 in pressure contact by providing an interference fit between at least a portion of the outer surfaces of the side walls 26 of the inner sleeve 12 and the inner surfaces of the side walls 28 of the outer sleeve 22. The outer sleeve 22 also has a pair of opposed inwardly extending feet 32 disposed on a lower portion of the outer sleeve 22. Desirably, the side walls 28 of the outer sleeve 22 have inwardly facing surfaces that taper from top to bottom. For example, in an exemplary embodiment, the outside surface of the side walls 26 of the inner sleeve 12 are spaced apart at a distance of 0.350 inches in a free unconfined state. Also, in a free unconfined state, the inner surfaces of the outer sleeve 22 at the top of the side walls 28 are spaced apart a distance of 0.355 inches at the top of side walls 28. The side walls 28 of the outer sleeve thicken from top to bottom from a 0.025 inch thickness at the top to a 0.030 inch thickness at the bottom to provide a spaced-apart distance of 0.346 in. at the bottom, thus assuring an interference with the inner sleeve 12 of 0.004 in. when assembled together.

Figure 2:
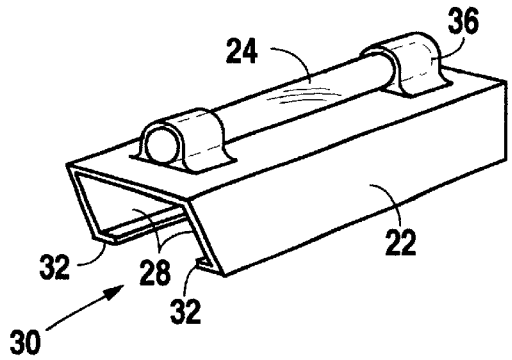
FIG. 2 is a three-dimensional view of a first embodiment of an outer sleeve component of the removable sight assembly embodying the present invention with an aiming indicia mounted on the outer sleeve.

As illustrated in FIG. 2, the front end 30 of the outer sleeve 22 is desirably outwardly tapered to provide an oblique opening to guide the outer sleeve 22 onto the inner sleeve 12 during assembly. This permits the forward end 30 of the outer sleeve 22 to initially engage the rearward end of the inner sleeve 12 and then slide longitudinally along the rib 14, over the pre-positioned inner sleeve 12. Finally, the outer sleeve 22 is pushed forward to a position whereat the forward end 30 of the outer sleeve 22 is adjacent a pre-existing bead or blade 34 on the rib 14. Importantly, the outer sleeve 22 forces the inner sleeve 12 into intimate pressed contact with both the rib 14 and the inner surface of the outer sleeve 22. This locks the removable sight assembly 10 in a fixed position on the rib 14.

Figure 5:
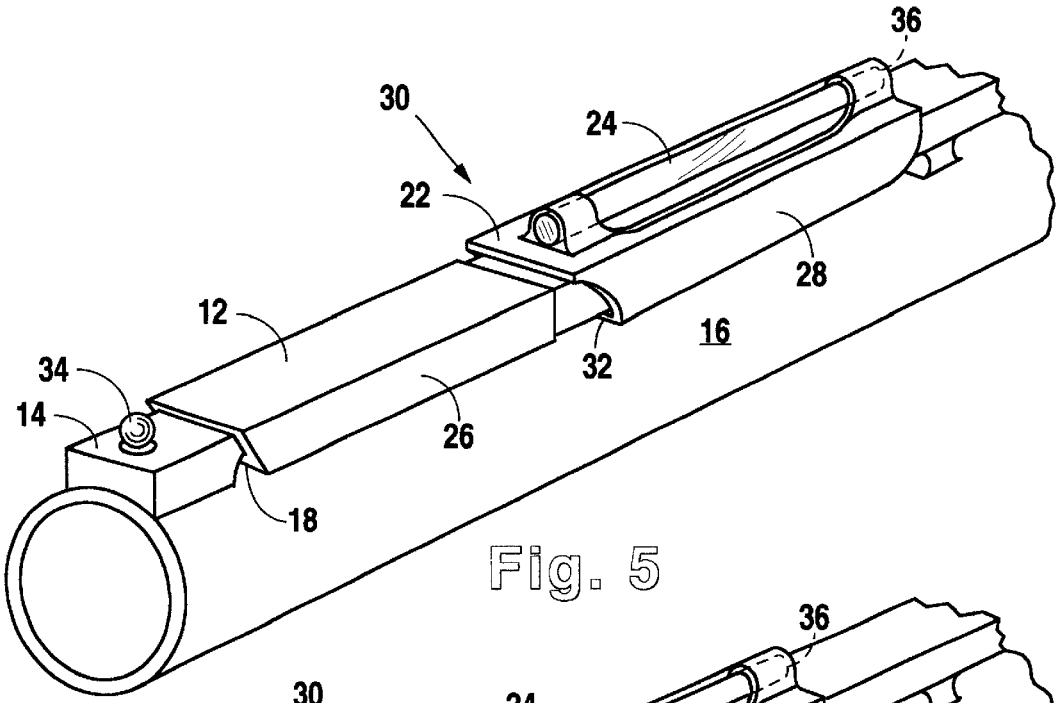
FIGS. 5–7 are three-dimensional views illustrating the assembly sequence of the first embodiment of the removable sight assembly on the barrel-mounted rib of a weapon.
Figure 6:
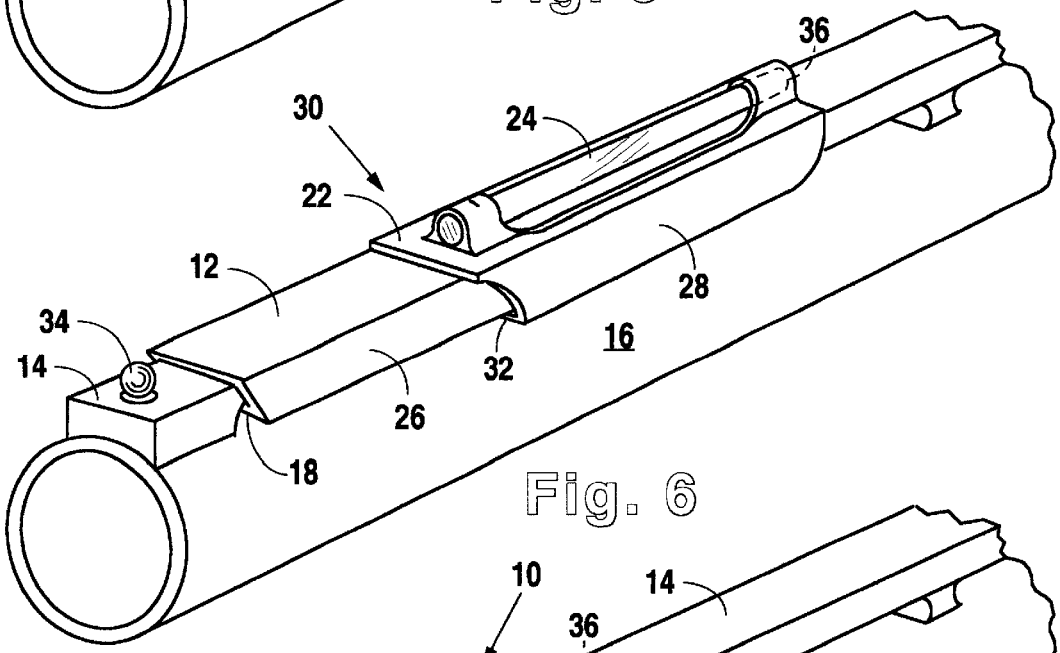
Figure 7:
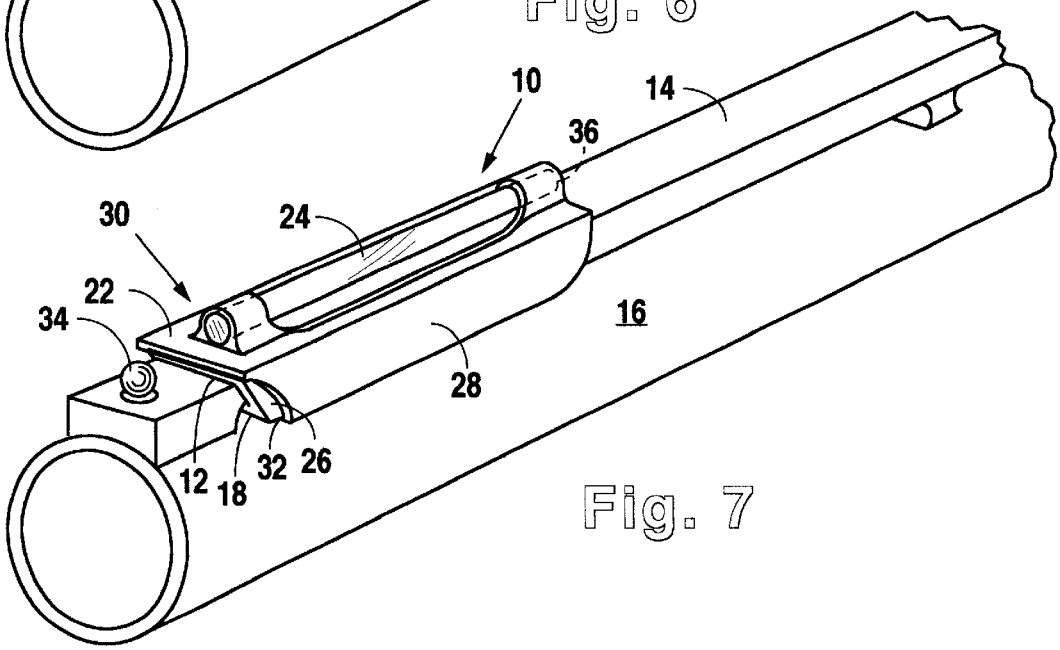

More specifically, the inner sleeve 12, is first placed over the rib 14 of the barrel 16 by slightly spreading the side walls 26 and moving the lower inwardly-extending feet 18 outwardly to clear the sides of the rib 14. The outer sleeve 22 is then positioned loosely over the rib 14 behind the inner sleeve 12, as illustrated in FIG. 5. After initial installation of the sleeves 12, 22, the outer sleeve 22 is moved forwardly over the inner sleeve 14, as shown in FIG. 6, thereby pressing the inner sleeve 12 into intimate contact with rib 12 and providing tight frictional engagement between the inner sleeve 12 and the rib 14 and between the inner sleeve 12 and the outer sleeve 22 Movement of the outer sleeve 22 forwardly, over the inner sleeve 12, is continued until the outer sleeve 22 and the inner sleeve 12 are aligned in a fixed position adjacent the forward end of the rib 14 of the barrel 16 as shown in FIG. 7.

Figure 3:
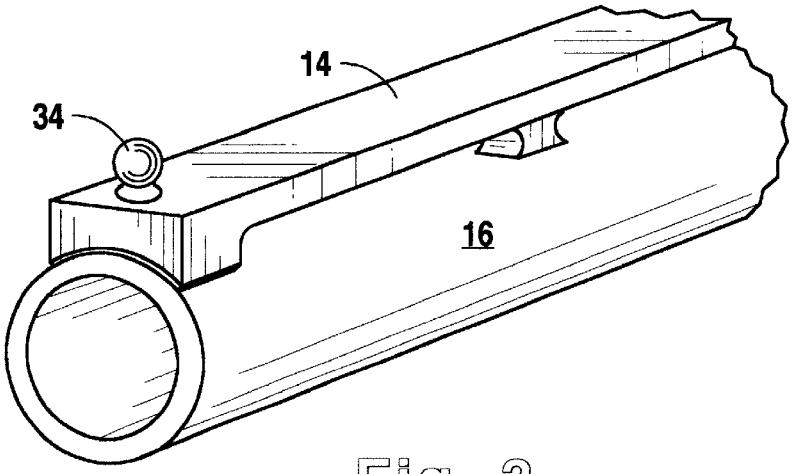
FIG. 3 is a three-dimensional view of the barrel of a weapon having a rib formed at a forward end thereof on which the sight assembly components illustrated in FIGS. 1 and 2 are mountable.
Figure 4:
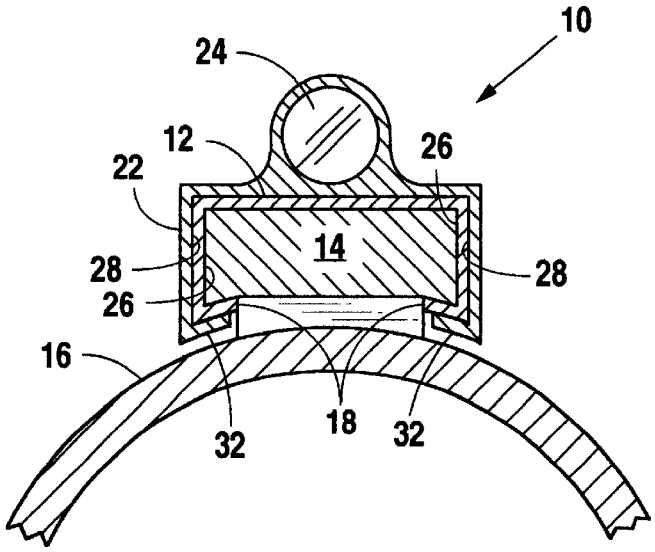
FIG. 4 is a cross-sectional view of the first embodiment of the present invention, as illustrated in FIGS. 1 and 2, mounted on the rib of the weapon illustrated in FIG. 3.

A gun barrel 16 having a ventilated rib 14, suitable for use in receiving the removable sight assembly 10 embodying the present invention is illustrated in FIG. 3. The removable sight 10 embodying the present invention, assembled on the vented rib 14 illustrated in FIG. 3, is shown in cross-section in FIG. 4. In the assembled position, the lower surface of the inwardly extending feet 32 of the outer sleeve 22 are slightly spaced from the surface of the weapon barrel 16 when the outer sleeve 22 is installed over the inner sleeve 12. Upon firing, the explosive reaction exerts a rearward force on the weapon, thereby tending to move the inner and outer sleeves 12, 22 in a forward direction, toward the pre-existing bead 34 at the end of the rib 14. However, due to the tight frictional engagement of the inner sleeve 12 with the rib 14 and outer sleeve 22, the two-piece removable sight 10 remains in place, in stable fixed position, during operation of the weapon. This is particularly true when the inwardly extending feet 18, 32 wrap around a vented rib by an amount sufficient to abut at least one of the vented ribs. The removable sight 10 embodying the present invention does not become displaced as may occur with magnetically or adhesively attached removable sights.

Although a longitudinal light-gathering fiber-optic segment 24 having a light emitting face or bead 36 providing an aiming indicia at a rearwardly facing end is illustrated in FIGS. 2 and 5–7, it should be understood that other types of aiming indicia, for example front and/or rear sight optical fibers having a radioactive light source or other augmented light source, or a light-gathering fiber-optic bead having a reflected light source such as a reflective surface on the top surface of the outer sleeve at a position under the fiber-optic bead, are especially beneficial for providing both day and night sight capability to the removable sight assembly 10. Such sights, useful in both forward- and rear-mounted applications, are described in detail in U.S. Pat. No. 5,956,854 granted on Sep. 28, 1999 to Paul M. LoRocco, the inventor of the present invention. The recently issued patent is entitled DAY/NIGHT WEAPON SIGHT, and the details of the sight elements described in that patent are incorporated herein. Also, a laser-generated beam sight may be mounted, typically at a rear position, on the weapon barrel 16. Thus, it can be readily seen that a suitable night sight having an emitted beam, or an illuminated bead, or a light-emitting face 36 facing the user, is especially suited for use as either a front or rear sight when mounted on the outer sleeve 22 of the removable sight 10 embodying the present invention. In addition, a sighting scope may be mounted on the outer sleeve 22.

Figure 8:
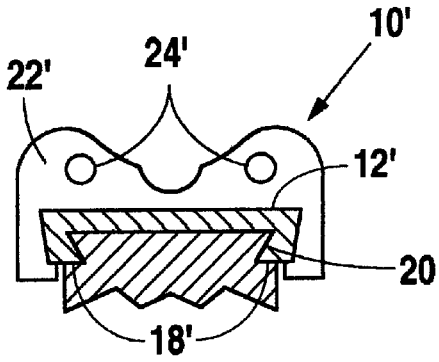
FIG. 8 is a cross-sectional view of a second embodiment of the present invention, showing the removable sight assembly mounted on a dovetail slot provided on a weapon.

In other embodiments the inwardly extending feet 18' of the inner sleeve 12' extend into a portion of a dovetail slot 20 as illustrated in FIG. 8. In yet another embodiment, the inner sleeve 12' wraps around the barrel 16" past the centerline of the barrel, and preferably at least about 60% of the circumference of the barrel 16", as illustrated in FIGS. 9 and 10.

A cross section of the second illustrated embodiment of the removable sight 10' embodying the present invention is shown in FIG. 8. In this embodiment, a removable sight 10' is shaped to engage a dovetail recess 20 provided in a rail mounted on the barrel of a weapon, for example, at the rear of the barrel. As a rear sight, the sight 10' itself may comprise two or more laterally spaced apart sighting elements 24', as described in more detail in the above-referenced U.S. Pat. No. 5,956,854. As in the earlier embodiments, when the sight support system 10' is installed, the inner sleeve 12' is compressed between the mounting surface 20 and the outer sleeve 22".

Figure 9:
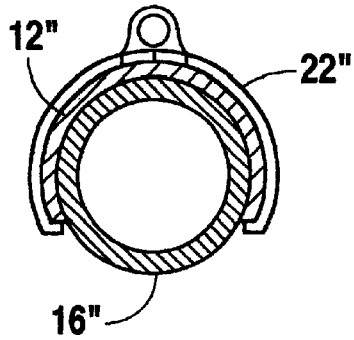
FIG. 9 is a cross-sectional view of a third embodiment of the removable sight assembly embodying the present invention, showing the removable sight assembly mounted on a smooth-barreled weapon.
Figure 10:
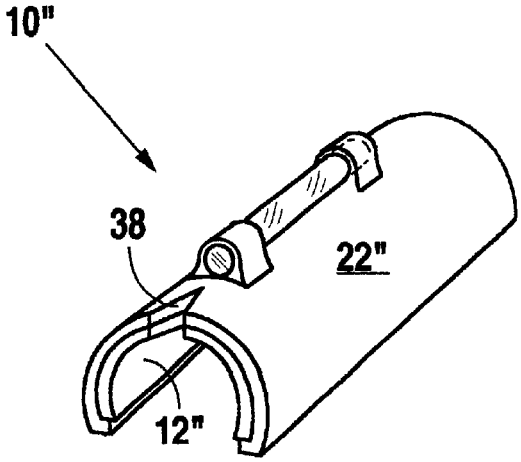
FIG. 10 is a three-dimensional view of the removable sight assembly adapted for use on a smooth-barreled weapon, as shown in cross-section in FIG. 9.

In a third illustrated embodiment, suitable for use on a smooth-barreled weapon, such as a shotgun, a removable sight 10" is mounted directly onto the barrel 16", as illustrated in cross section in FIG. 9 and in a three-dimensional view in FIG. 10. In this embodiment, both the inner and outer sleeves 12", 22" wrap around more than one-half, and preferably at least about 60%, of the circumference of the barrel 16". As an aid to radial alignment of the removable sight 10", a notch 38, adapted to engage an existing bead or blade, may be provided at the forward end of the removable sight 10" as illustrated in FIG. 10. As in the earlier embodiments, the inner and outer sleeves 12", 22" are sized such that when the removable sight 10" is installed, the inner sleeve 12" is compressed between the barrel 16" and the outer sleeve 22".

In all embodiments of the present invention, it should be noted that the inner sleeve 12 is desirably compressible, and at least somewhat flexible. This feature allows a particular inner and outer sleeve pair to be used on similar, but slightly varying or differently-sized mounting surfaces. Also, it is possible to use a single outer sleeve 22 with a number of different inner sleeves 12 having the same outer dimensions but which are shaped inwardly to mate with different mounting surfaces.

Although the present invention has been illustrated by three exemplary embodiments, it can be readily understood that similar multiple-component removable sight structures can be formed, based on the teaching of this invention. While it is important that the outer sleeve 22 have greater rigidity than the inner sleeve 12, there is a wide range of varying flexibility of the two components that would be suitable for use in the removable sight illustrated herein. For example, the inner sleeve 12 could be formed of a highly compressible or flexible material, with the outer sleeve 22 accordingly providing sufficient interference to produce the pressure necessary to retain the two components 12, 22 together on the rib 14 during operation of the weapon. Furthermore, as referenced above, a wide variety of aiming indicia may be mounted on the outer sleeve 22, depending upon the particular intended use application of the weapon. Other aspects, features and advantages of the present invention may be obtained from a study of this disclosure and the drawings, along with the appended claims.

What I claim is:

1. A removable sight assembly for a weapon, said assembly comprising an inner sleeve having a lower portion, an outer sleeve, and an aiming indicia mounted on the outer sleeve, said outer sleeve being adapted to circumscribe the inner sleeve and having an opposed pair of feet disposed on a lower portion thereof and extending inward from the outer sleeve, said feet being adapted to extend in covering relationship over at least a portion of the lower portion of said inner sleeve, said inner sleeve having a predefined outer shape when said inner sleeve is in a free unconfined state and said outer sleeve having a predefined inner shape when said outer sleeve is in a free unconfined state wherein said predefined outer shape of the inner sleeve provides an interference fit with at least a portion of the predefined inner shape of the outer sleeve when assembled only with each other, said inner sleeve being pressed between said outer sleeve and a predefined feature of said weapon and said feet of the outer sleeve being disposed in non-contacting relationship with said predefined feature of said weapon when said removable sight assembly is mounted on said weapon.

2. The removable sight assembly, as set forth in claim 1, wherein said outer sleeve is formed of a substantially non-compressible, rigid material having a predefined hardness, and said inner sleeve is formed of a material having a hardness less than said predefined hardness of said outer sleeve.

3. The removable sight assembly, as set forth in claim 1, wherein said inner sleeve is adapted to form an interference fit with said predefined feature of the weapon.

4. The removable sight assembly, as set forth in claim 1, wherein said predefined feature of said weapon includes a portion of a barrel of said weapon, said barrel having a predefined radial outer surface, and said inner and outer sleeves circumscribe a major portion of said radial outer surface of the barrel.

5. The removable sight assembly, as set forth in claim 4, wherein said inner and outer sleeves circumscribe at least 60% of said radial outer surface of the barrel.

6. A removable sight assembly for a weapon, said assembly comprising an inner sleeve having a lower portion, an outer sleeve, and an aiming indicia mounted on the outer sleeve, said outer sleeve being adapted to circumscribe the inner sleeve and having an opposed pair of inwardly extending feet disposed on a lower portion thereof, said inwardly extending feet being adapted to extend in covering relationship over at least a portion of the lower portion of said inner sleeve, said inner sleeve having a predefined outer shape when said inner sleeve is in a free unconfined state and said outer sleeve having a predefined inner shape when said outer sleeve is in a free unconfined state wherein said predefined outer shape of the inner sleeve provides an interference fit with at least a portion of the predefined inner shape of the outer sleeve when assembled only with each other, said inner sleeve being pressed between said outer sleeve and a predefined feature of said weapon and said inwardly extending feet of the outer sleeve being disposed in non-contacting relationship with said predefined feature of said weapon when said removable sight assembly is mounted on said weapon, wherein said predefined feature of said weapon comprises a rib mounted on a portion of a barrel of said weapon and said inner and outer sleeves circumscribe at least a portion of said rib.

7. The removable sight assembly, as set forth in claim 6, wherein at least one of the inwardly extending feet wraps around the rib by an amount sufficient to abut the rib.

8. The removable sight assembly, as set forth in claim 6, wherein said outer sleeve is formed of a substantially non-compressible, rigid material having a predefined hardness, and said inner sleeve is formed of a material having a hardness less than said predefined hardness of said outer sleeve.

9. The removable sight assembly, as set forth in claim 6, wherein said inner sleeve is adapted to form an interference fit with said predefined feature of the weapon.

10. A removable sight assembly for a weapon, said assembly comprising an inner sleeve having a lower portion, an outer sleeve, and an aiming indicia mounted on the outer sleeve, said outer sleeve being adapted to circumscribe the inner sleeve and having an opposed pair of inwardly extending feet disposed on a lower portion thereof, said inwardly extending feet being adapted to extend in covering relationship over at least a portion of the lower portion of said inner sleeve, said inner sleeve having a predefined outer shape when said inner sleeve is in a free unconfined state and said outer sleeve having a predefined inner shape when said outer sleeve is in a free unconfined state wherein said predefined outer shape of the inner sleeve provides an interference fit with at least a portion of the predefined inner shape of the outer sleeve when assembled only with each other, said inner sleeve being pressed between said outer sleeve and a predefined feature of said weapon and said inwardly extending feet of the outer sleeve being disposed in non-contacting relationship with said predefined feature of said weapon when said removable sight assembly is mounted on said weapon, wherein said predefined feature of said weapon comprises a dovetail slot provided in a rail structure disposed on said weapon, said inner sleeve is adapted to engage said dovetail slot, and said outer sleeve is adapted to circumscribe said inner sleeve and at least a portion of said rail structure.

11. The removable sight assembly, as set forth in claim 10, wherein said outer sleeve is formed of a substantially non-compressible, rigid material having a predefined hardness, and said inner sleeve is formed of a material having a hardness less than said predefined hardness of said outer sleeve.

12. The removable sight assembly, as set forth in claim 10, wherein said inner sleeve is adapted to form an interference fit with said predefined feature of the weapon.

* * * * *